FIG. 1
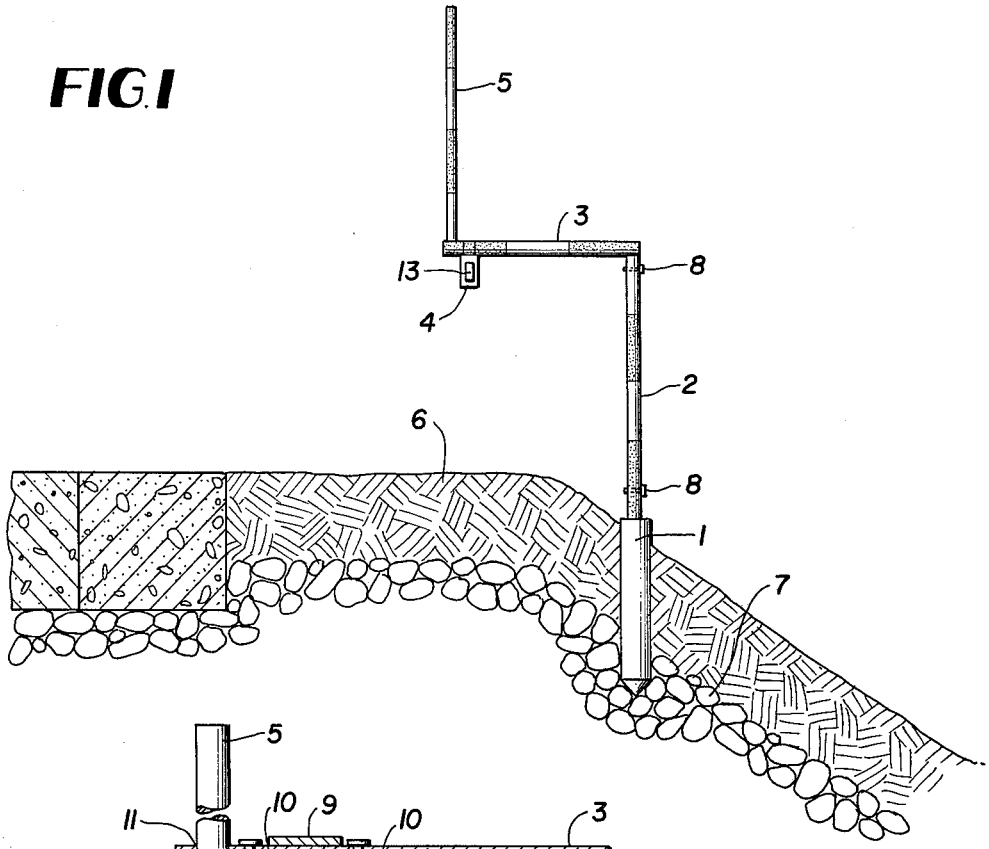
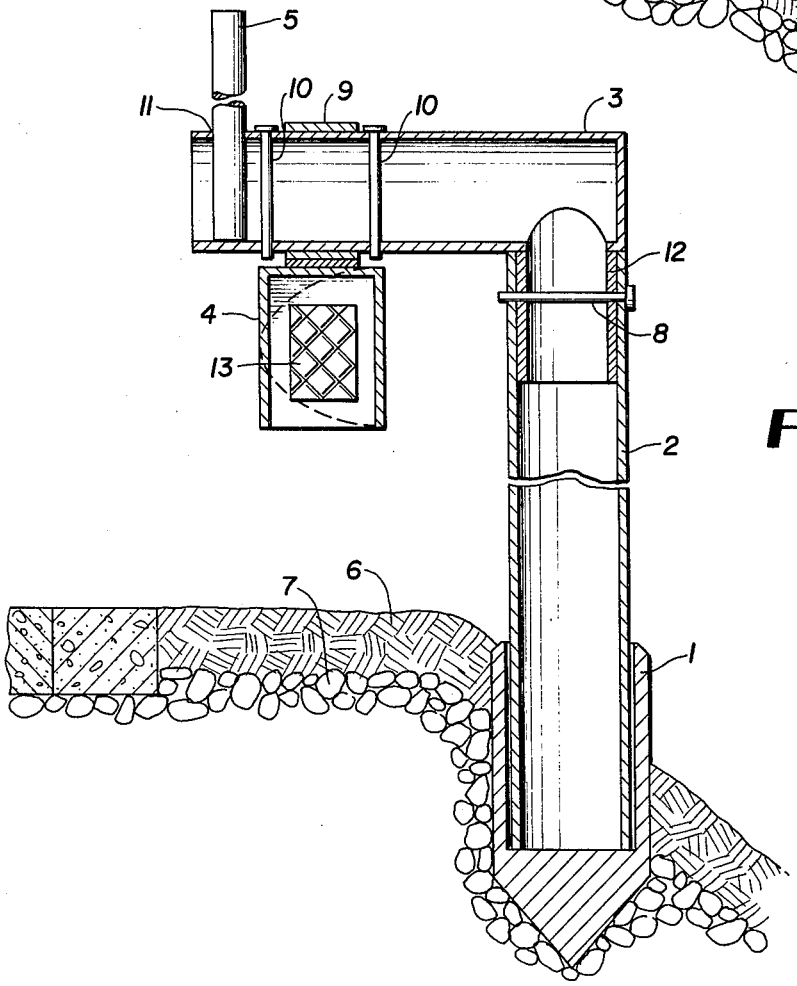
FIG. 2

FIG. 4
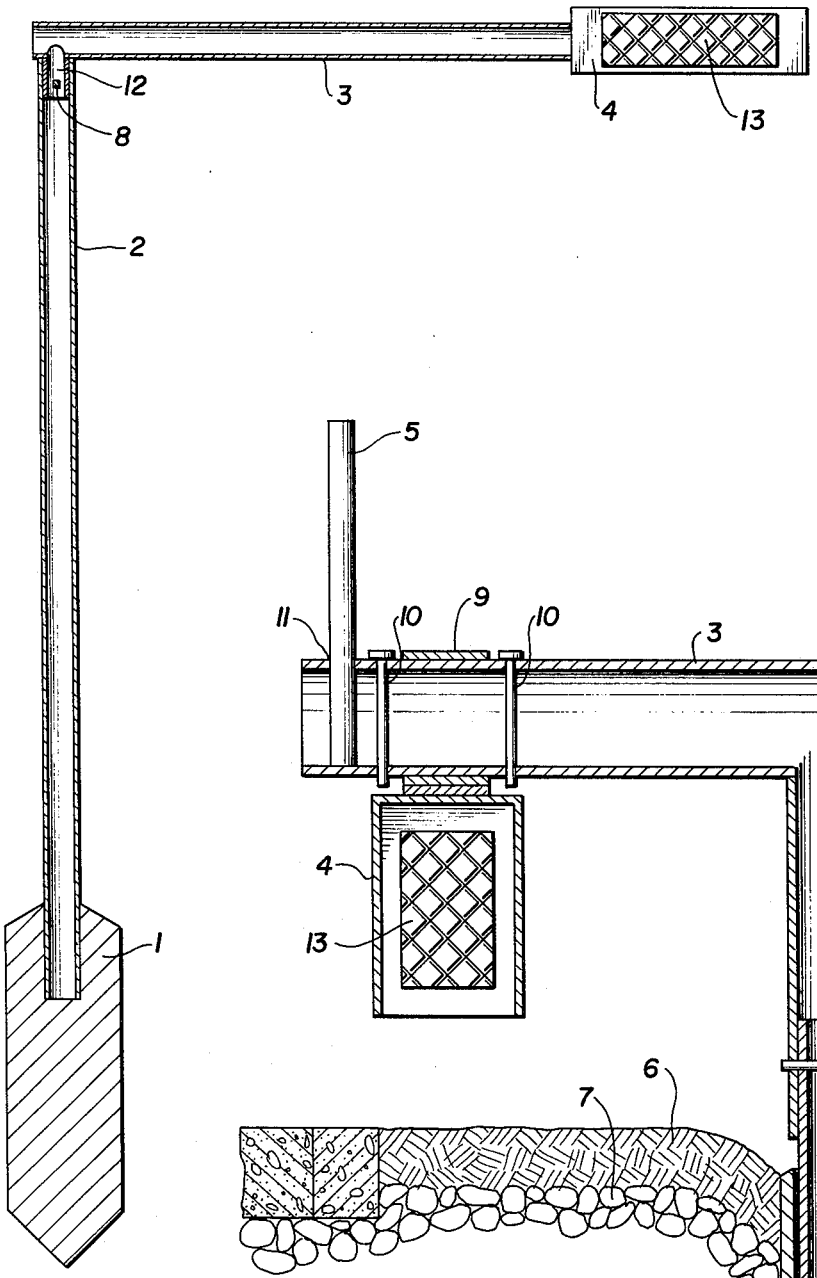
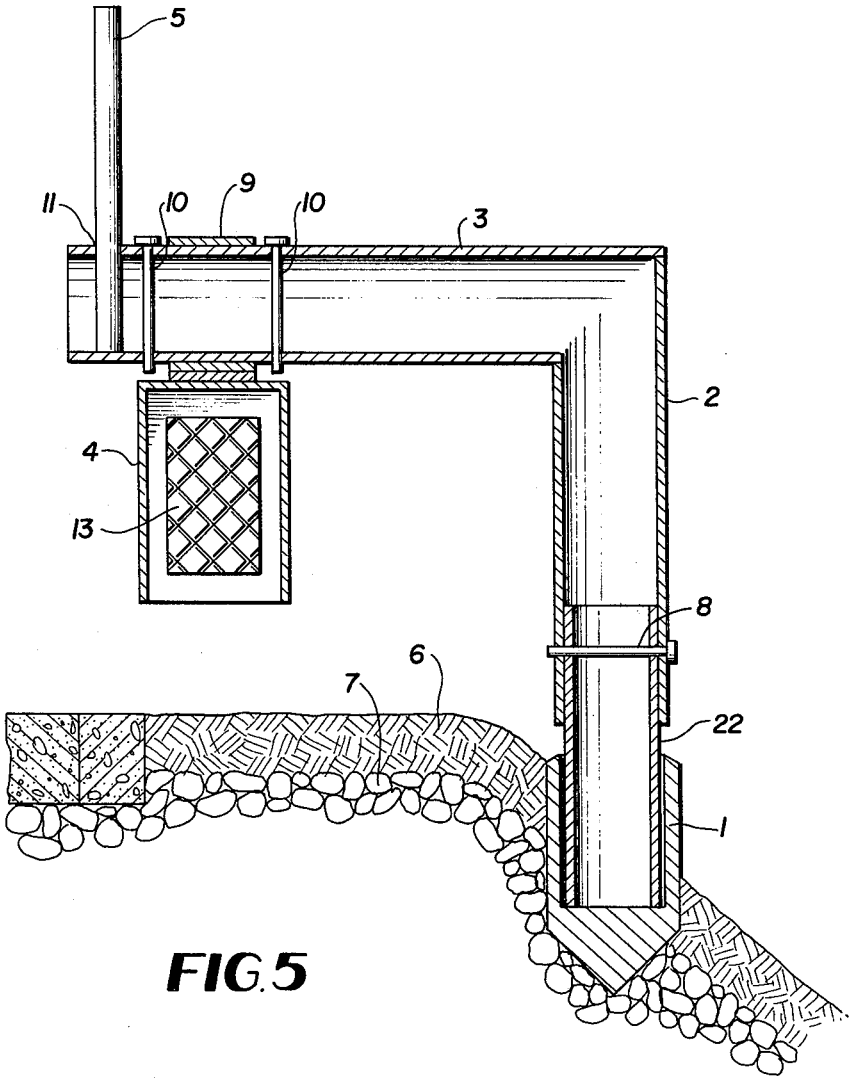
FIG. 5

CONSOLE TRAFFIC DIRECTION POST

A continuation in part of Ser. No. 107,972 filed Dec. 28, 1979.

The subject of the invention is a console traffic direction post intended for highway engineering and for regulating vehicle traffic on highways, as a replacement of the existing direction posts.

It is the characteristic of the existing console traffic direction posts that they are located on the shoulders of the highway at a certain distance from the pavement edge, in form of vertical objects of a certain height. With such a location, the direction posts are exposed to destruction by vehicles and machines used for grass mowing, humus and snow clearance. Mechanised highway maintenance of pavements and shoulders, such as grass mowing, snow and humus clearance is, thus, considerably delayed and made difficult and partially enables full and high-quality execution of these tasks. Setting up new direction posts is very expensive and takes time. For these reasons security of traffic participants is reduced because direction posts are missing and as their replacement is slow, they are merely visible and partly covered by humus, snow, grass and weeds.

The advantages of console traffic direction posts compared to existing direction posts include the following:

they permit easier, quicker and higher quality maintenance of the shoulder and the pavement in cases of grass mowing, or removal of humus and dirt from the shoulder;

they offer a better solution for snow clearance;

they simplify and facilitate placing of the direction sticks in winter, they substantially reduce possibilities of breaking down and damage and facilitate repair. Their height can be regulated and they can be disassembled easily, if necessary.

Thus is obtained security of traffic participants, better highway maintenance quality, and this leads to favourable economic effects.

The console traffic direction post will be explained by the enclosed figures.

FIG. 1 illustrates an outer view of the console traffic direction post with a view of a highway.

FIG. 2 shows a vertical section of the console traffic direction post having a movable connection between the vertical and horizontal carrier, with the reflector stud hanging and being rotatable about the horizontal arm carrier.

FIG. 4 is a vertical section of the console traffic direction post having a movable connection between the vertical and horizontal carrier with the reflector stud being placed at the extremity of the horizontal carrier.

FIG. 5 is a vertical section of the console traffic direction post having a firm connection between the vertical and the horizontal carrier with the reflector stud hanging and being rotatable about the horizontal carrier.

Figure 3:
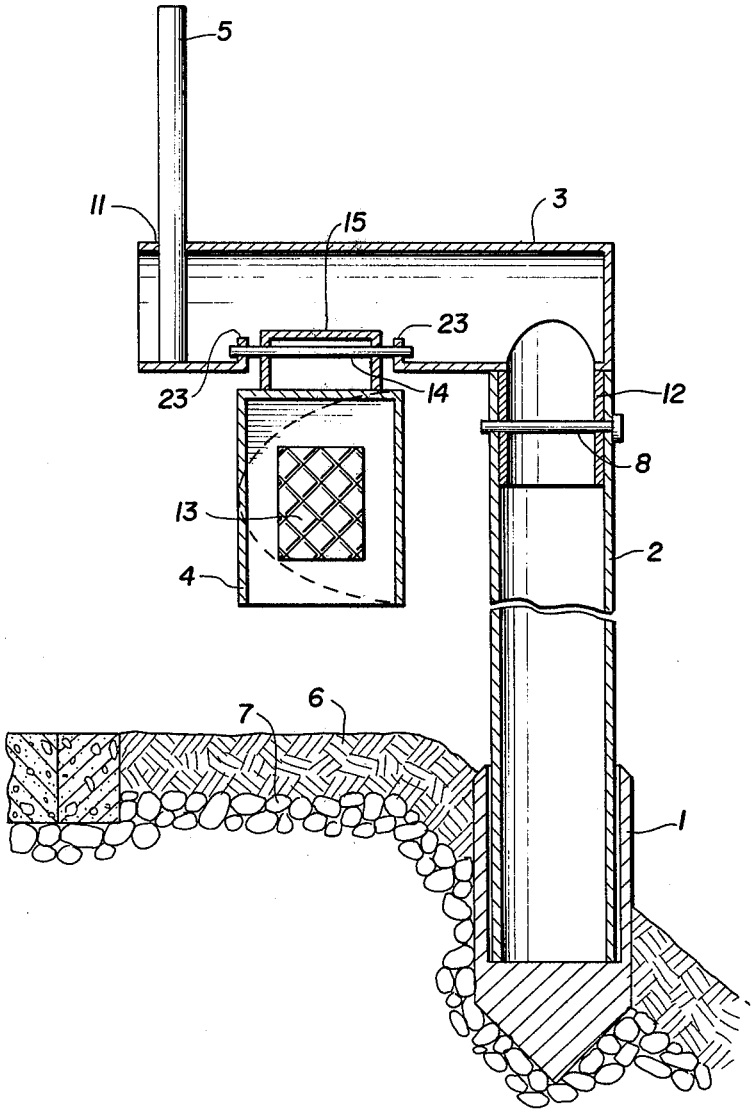
FIG. 3 shows a vertical section of the console traffic direction post having a movable connection between the vertical and horizontal carrier, with the reflector stud hanging and being rotatable about the axis in the horizontal carrier.

As shown in FIGS. 1 and 2, the console traffic direction post is composed of a prefabricated staking carrier 1 that is mechanically or manually driven into a predrilled hole on the embankement of about 10% smaller diameter than the carrier 1. In the staking carrier 1 is inserted a vertical support post 2 on which is placed a movable horizontal arm carrier 3. To the carrier 3 is firmly connected a support device 12 that is inserted in support post 2. The connection between support device 12 and support post 2 is performed by a plastic safety device 8, through which pass support post 2 and support device 12.

At the extremity of horizontal arm carrier 3 a socket 9, limited by terminators 10, is put on. On the socket 9 is tightened a reflector stud 4 that is rotatable about the arm carrier 3 together with socket 9. The stud 4 can have different transversal sections but a triangle form is the most convenient one. At the extremity of arm carrier 3, in opening 11, a vertical direction stick 5 can be inserted in winter during high snows.

All the elements of the console traffic direction post can be produced from different materials, but the most convenient is plastic.

In FIG. 3 the same elements of the console traffic direction post are shown as in FIG. 2. The difference is that in FIG. 3 the reflector stud 4 is hanging, by carrier 15, to axis 14 placed in opening 23, on arm carrier 3. The reflector stud 4 can swing on axis 14 leaning on carriers 15.

In FIG. 4 the console traffic direction post has the same elements as shown on FIG. 2 and is used in areas that do not have snow, so that the direction stick 5 isn't placed on arm carrier 3. In this case, the stud 4 is directly built in the extremity of horizontal arm carrier 3. The stud 4 can have different transversal sections but a ring form is the most convenient one.

In FIG. 5 the console traffic direction post is similar to the construction shown in FIG. 2 with the same elements. The difference is that in FIG. 5 the vertical support post 2 and the horizontal arm carrier 3 are mutually firmly connected. The vertical support post 2 is inserted into vertical support post 22 and they are connected by a plastic safety device 8, while the support post 22 is inserted into staking element 1.

Figure 6:
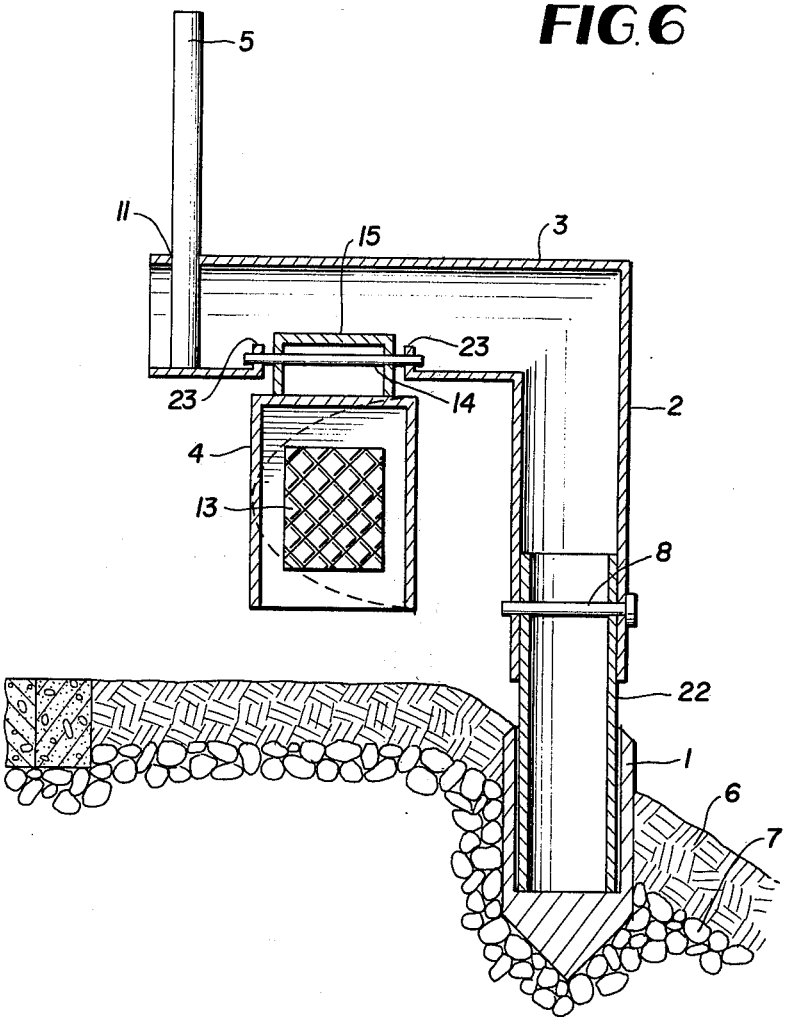
FIG. 6 is a vertical section of the console traffic direction post, having a firm connection between the vertical and the horizontal carrier with the reflector stud hanging and swinging on the axis in the horizontal carrier.

FIG. 6 shows the console traffic direction post of the same construction as in FIG. 5 except that the stud 4 is hanging, by carrier 15, to axis 14 placed in opening 23 on arm carrier 3.

Figure 7:
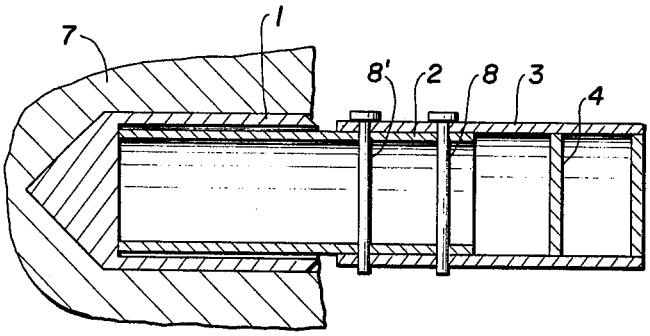
FIG. 7 illustrates a vertical section of the console traffic direction post having a movable connection of the horizontal carrier and a carrier that is built in an oblique or vertical rock or wall, the reflector stud being placed at the extremity of the horizontal carrier.

The construction of the console traffic direction post, according to the performance illustrated in FIG. 7, is used or placed in the case when the sides of the highway are more or less vertical rocks or walls 7, for example in tunnels, support walls, cuts etc. The horizontal arm carrier 3 is connected by thin plastic safety devices 8 and 8' to the support post 2, inserted into staking carrier 1 of a rock or wall 7. The safety device 8 is easier to break than safety device 8'. By this way of performing, the stud 4 is directly tightened to the extremity of arm carrier 3. The safety devices 8 and 8' are plastic and small in diameter, usually 2 to 3 mm, so that they can

CONSOLE TRAFFIC DIRECTION POST

A continuation in part of Ser. No. 107,972 filed Dec. 28, 1979.

The subject of the invention is a console traffic direction post intended for highway engineering and for regulating vehicle traffic on highways, as a replacement of the existing direction posts.

It is the characteristic of the existing console traffic direction posts that they are located on the shoulders of the highway at a certain distance from the pavement edge, in form of vertical objects of a certain height. With such a location, the direction posts are exposed to destruction by vehicles and machines used for grass mowing, humus and snow clearance. Mechanised highway maintenance of pavements and shoulders, such as grass mowing, snow and humus clearance is, thus, considerably delayed and made difficult and partially enables full and high-quality execution of these tasks. Setting up new direction posts is very expensive and takes time. For these reasons security of traffic participants is reduced because direction posts are missing and as their replacement is slow, they are merely visible and partly covered by humus, snow, grass and weeds.

The advantages of console traffic direction posts compared to existing direction posts include the following:

they permit easier, quicker and higher quality maintenance of the shoulder and the pavement in cases of grass mowing, or removal of humus and dirt from the shoulder;

they offer a better solution for snow clearance;

they simplify and facilitate placing of the direction sticks in winter, they substantially reduce possibilities of breaking down and damage and facilitate repair. Their height can be regulated and they can be disassembled easily, if necessary.

Thus is obtained security of traffic participants, better highway maintenance quality, and this leads to favourable economic effects.

The console traffic direction post will be explained by the enclosed figures.

FIG. 1 illustrates an outer view of the console traffic direction post with a view of a highway.

FIG. 2 shows a vertical section of the console traffic direction post having a movable connection between the vertical and horizontal carrier, with the reflector stud hanging and being rotatable about the horizontal arm carrier.

FIG. 3 shows a vertical section of the console traffic direction post having a movable connection between the vertical and horizontal carrier, with the reflector stud hanging and being rotatable about the axis in the horizontal carrier.

FIG. 4 is a vertical section of the console traffic direction post having a movable connection between the vertical and horizontal carrier with the reflector stud being placed at the extremity of the horizontal carrier.

FIG. 5 is a vertical section of the console traffic direction post having a firm connection between the vertical and the horizontal carrier with the reflector stud hanging and being rotatable about the horizontal carrier.

FIG. 6 is a vertical section of the console traffic direction post, having a firm connection between the vertical and the horizontal carrier with the reflector stud hanging and swinging on the axis in the horizontal carrier.

FIG. 7 illustrates a vertical section of the console traffic direction post having a movable connection of the horizontal carrier and a carrier that is built in an oblique or vertical rock or wall, the reflector stud being placed at the extremity of the horizontal carrier.

As shown in FIGS. 1 and 2, the console traffic direction post is composed of a prefabricated staking carrier 1 that is mechanically or manually driven into a predrilled hole on the embankement of about 10% smaller diameter than the carrier 1. In the staking carrier 1 is inserted a vertical support post 2 on which is placed a movable horizontal arm carrier 3. To the carrier 3 is firmly connected a support device 12 that is inserted in support post 2. The connection between support device 12 and support post 2 is performed by a plastic safety device 8, through which pass support post 2 and support device 12.

At the extremity of horizontal arm carrier 3 a socket 9, limited by terminators 10, is put on. On the socket 9 is tightened a reflector stud 4 that is rotatable about the arm carrier 3 together with socket 9. The stud 4 can have different transversal sections but a triangle form is the most convenient one. At the extremity of arm carrier 3, in opening 11, a vertical direction stick 5 can be inserted in winter during high snows.

All the elements of the console traffic direction post can be produced from different materials, but the most convenient is plastic.

In FIG. 3 the same elements of the console traffic direction post are shown as in FIG. 2. The difference is that in FIG. 3 the reflector stud 4 is hanging, by carrier 15, to axis 14 placed in opening 23, on arm carrier 3. The reflector stud 4 can swing on axis 14 leaning on carriers 15.

In FIG. 4 the console traffic direction post has the same elements as shown on FIG. 2 and is used in areas that do not have snow, so that the direction stick 5 isn't placed on arm carrier 3. In this case, the stud 4 is directly built in the extremity of horizontal arm carrier 3. The stud 4 can have different transversal sections but a ring form is the most convenient one.

In FIG. 5 the console traffic direction post is similar to the construction shown in FIG. 2 with the same elements. The difference is that in FIG. 5 the vertical support post 2 and the horizontal arm carrier 3 are mutually firmly connected. The vertical support post 2 is inserted into vertical support post 22 and they are connected by a plastic safety device 8, while the support post 22 is inserted into staking element 1.

FIG. 6 shows the console traffic direction post of the same construction as in FIG. 5 except that the stud 4 is hanging, by carrier 15, to axis 14 placed in opening 23 on arm carrier 3.

The construction of the console traffic direction post, according to the performance illustrated in FIG. 7, is used or placed in the case when the sides of the highway are more or less vertical rocks or walls 7, for example in tunnels, support walls, cuts etc. The horizontal arm carrier 3 is connected by thin plastic safety devices 8 and 8' to the support post 2, inserted into staking carrier 1 of a rock or wall 7. The safety device 8 is easier to break than safety device 8'. By this way of performing, the stud 4 is directly tightened to the extremity of arm carrier 3. The safety devices 8 and 8' are plastic and small in diameter, usually 2 to 3 mm, so that they can easily break in case of a blow on horizontal arm carrier 3.

Plastic elements of the construction performance of the console traffic direction post are the most convenient ones.

According to the invention, the console traffic direction post is subject to changements of dimensions, forms and types of material, without depassing the limits of this invention.

I claim:

1. A console traffic direction post comprising:

(a) a stake having one end adapted for driving into the ground and an elongated hollow portion open at the other end for retaining within said stake a vertical support post;

(b) a vertical support post retained within the elongated hollow portion of the stake and extending vertically out from the open end thereof;

(c) a horizontal arm supported at one end on the vertical support post and extending horizontally therefrom;

(d) support means supporting the horizontal arm at one end thereof on the vertical support post comprising a socket allowing the horizontal arm to rotate normal to the vertical support post, and a shear pin extending through said socket, said shear pin preventing rotation of the horizontal arm under normal conditions; but capable of shearing when the horizontal arm is struck, to thereby allow the horizontal arm to rotate normal to the vertical support post;

(e) a reflector attached to said horizontal arm at the end thereof opposite the end supported on the vertical support post.

2. The console traffic direction post of claim 1 further characterized in that a vertical direction stick extending vertically from the horizontal arm is retained within an opening in said horizontal arm located proximate the end of said horizontal arm opposite the end supported on the vertical support post.

3. A console traffic direction post comprising:

(a) a stake having one end adapted for driving into the ground and an elongated hollow portion open at the other end for retaining a vertical support post within said stake;

(b) a vertical support post retained within the elongated hollow portion of the stake and extending vertically out from the open end thereof;

(c) a horizontal arm supported at one end on the vertical support post and extending horizontally therefrom;

(d) support means supporting the horizontal arm at one end thereof on the vertical support post comprising a socket allowing the horizontal arm to rotate normal to the vertical support post, and a shear pin extending through said socket, said shear pin preventing rotation of the horizontal arm under normal conditions, but capable of shearing when the horizontal arm is struck, to thereby allow the horizontal arm to rotate normal to the vertical support post;

(e) a freely rotatable reflector attached to said horizontal arm proximate the end thereof opposite the end supported on the vertical support post; and, (f) attachment means for movably attaching the reflector to the horizontal arm comprising a socket, the opening of which is defined by a cylinder having an inner cylindrical surface circumscribing the horizontal arm and an outer surface to which the reflector is affixed whereby said reflector is freely rotatable about the horizontal arm.

4. A console traffic direction post comprising:

(a) a stake having one end adapted for driving into the ground and an elongated hollow portion open at the other end for retaining a vertical support post within said stake;

(b) a vertical support post retained within the elongated hollow portion of the stake and extending vertically out from the open end thereof;

(c) a horizontal arm supported at one end on the vertical support post and extending horizontally therefrom;

(d) support means supporting the horizontal arm at one end thereof on the vertical support post comprising a socket allowing the horizontal arm to rotate normal to the vertical support post, and a shear pin extending through said socket, said shear pin preventing rotation of the horizontal arm under normal conditions, but capable of shearing when the horizontal arm is struck, to thereby allow the horizontal arm to rotate normal to the vertical support post;

(e) an opening on the underside of the horizontal arm proximate the end thereof opposite the end supported on the vertical support post;

(f) a rod within said opening axially oriented within the horizontal arm; and (g) a hanging reflector movably affixed to said rod.

5. The console traffic direction post of claims 1, 3, 2 or 4 further characterized in that two vertically separated shear pins are each passed through the support means socket.

6. The console traffic direction post of claims 1, 3, 2 or 4 further characterized in that two vertically separated shear pins of differing shear strength are each passed through the support means socket.

* * * * *